United States Patent [19]

Goossens et al.

[11] 4,059,412

[45] Nov. 22, 1977

[54] METHOD FOR PRODUCING FUEL BRIQUETTES

[75] Inventors: Walter Goossens; Wolfgang Hermann, both of Wuerselen-Bardenberg; Wilhelm Keusch, Baesweiler; Rudolf Redlich, Herzogenrath, all of Germany

[73] Assignee: Eschweiler Bergwerks-Verein Aktiengesellschaft, Herzogenrath-Kohlscheid, Germany

[21] Appl. No.: 692,376

[22] Filed: June 3, 1976

[30] Foreign Application Priority Data

June 4, 1975 Germany ..... 2524692

[51] Int. Cl.[2] ..... C10L 5/00

[52] U.S. Cl. ..... 44/10 H; 44/10 C

[58] Field of Search ..... 44/10 C, 10 D, 10 H

[56] References Cited

U.S. PATENT DOCUMENTS

| | | | |
|---|---|---|---|
| 3,841,849 | 10/1974 | Beckmann | 44/10 H |
| 3,856,481 | 12/1974 | Mikhailovich et al. | 44/10 H |

*Primary Examiner*—Carl F. Dees

*Attorney, Agent, or Firm*—W. G. Fasse; W. W. Roberts

[57] ABSTRACT

Fuel briquettes are produced by hot pressing a mixture of a fine grained coal softening at the pressing temperature and a coal component which hardly or not at all softens at the pressing temperature. The starting materials are converted into a granular structure material by the use of pure oxygen or an oxygen/nitrogen mixture having an oxygen content above 21% by volume so that the resulting granular material has a bulk weight of between 0.3 t/m³ to 0.7 t/m³.

2 Claims, No Drawings

METHOD FOR PRODUCING FUEL BRIQUETTES

BACKGROUND OF THE INVENTION

The invention relates to a method for producing of fuel briquettes by hot pressing a mixture including a fine grained coal which softens at the pressing temperature and a component which does not or hardly soften at the pressing temperature whereby the starting components prior to their being mixed, are heated to different temperatures by first introducing the non-softening component, as viewed in the flow direction, into a flow of a heating gas and thereafter introducing the softening component into the flow of a heating gas. After the heating of the components they are separated from the gas flow.

The quality properties in the production of hot briquettes such as their rigidity and low smoke production, do not depend only on the original properties of the starting raw materials, but are determined to a substantial extent also by the condition in which the raw materials are at the time of pressing.

In the known methods for producing fuel briquettes, efforts are made to achieve certain quality characteristics by means of defined raw material conditions of the mixture to be pressed, said conditions being achieved by a thermal disintegration. The techniques practiced heretofore, for the thermal treatment of solid, powderized, or granular fuels to degas or gasify such fuels, started from the assumption that it is necessary to first subject the substances to be treated in separate process steps to drying and milling to obtain a surface area as large as possible. The so treated materials were then separated according to size and then subjected to the actual thermal process. The raw materials are supposed to take on the desired state or condition by a determined heating and degasification of the starting components as well as by a further degasification of the mixture prior to the pressing and within a determined temperature time function.

The known method of oxygen enrichment, that is a process employing oxygen in proportions above the stoichiometric proportion, was employed with the intent to decompose coking hard coal in such a manner that the coal would lose its coking capability, which is to some extend a hindrance in the following process steps. Such oxygen enrichment of the smoke gases, which in addition to functioning as the heat transfer means also performs the function of a carrier medium, resulted in addition to the desired destruction of the coking characteristic, in an undesirable and uneconomical carbon combustion.

SUMMARY OF THE INVENTION

It is the object of the invention to heat the starting components and to thermally decompose such starting components with a medium which may be adjusted in a wide range with regard to the type of the starting components in such a manner that the different raw materials are able to assume precisely defined states prior to the pressing operation.

According to the invention the foregoing objective is achieved by performing the following process steps in such a manner that pure oxygen or an oxygen-nitrogen mixture is used as a reaction component of a heating medium and as a process regulating medium, wherein said oxygen-nitrogen mixture includes more than 21% by volume of oxygen, preferrably in a ratio of 2:1 up to the stoichiometric ratio, and by producing a carrier gas having temperatures between 1000° C and 1700° C in such a manner that, adjusted to the type of starting components which are present in unclassified grain sizes up to 14mm, granular structures are obtained which result in bulk weights of between 0.3 t/m$^3$ to 0.7 t/m$^3$ prior to the intermixing, at average or mean heat up speeds of about 2500° C/sec and end temperatures of between 350° C to 700° C of the non-softening, i.e., substantially undeformable or hardly softening component.

DETAILED DESCRIPTION OF PREFERRED EXAMPLE EMBODIMENTS

Due to the use of oxygen, or a defined oxygen mixture according to the invention as a reaction component with a heating medium, and as a result of the controllability in a wide range, it is possible to treat different starting materials in such a manner that prior to the compressing of the mixture exactly defined raw material conditions are achievable.

The reduction of the nitrogen of the combustion air results in more advantageous partial pressure ratios and in higher radiation intensities of the reaction atmosphere so that it is possible to work with lower heating temperatures and thus with milder process conditions whereby the solid materials are treated more gently and whereby it is possible to obtain the bulk weights which are desirable for briquetting. The reaction atmosphere selected for the process according to the invention may be adjusted by the oxygen of the oxygen/nitrogen mixture when the combustion of the fuel or gas takes place at stoichiometric conditions. Said adjustment being such that depending on the respective type of coal used a bulk weight suitable for the briquetting or a heterogeneous grain structure may be produced. The formation of a heterogeneous grain structure is enhanced by the above mentioned coarse range of grain sizes.

The technical solution of the process steps necessary for the stated objective may be accomplished with the flying stream reaction technique available from the "ansit" (R.T.M.) hot briquetting technique. As is known, the heating of solid fuels is accomplished in the "ancit" (R.T.M.) method by a single source of energy namely the combustion chamber connected upstream of the flying stream or flow reactor. Heretofore a fuel gas air mixture was supplied to this combustion system. The hot fire gases generated by the combustion served for the heating of the solid fuel.

According to the above described process steps, the high proportion of inert components in the flue or smoke gas is now reduced in that the combustion air and a portion of the carrier air is heated by a respective proportion of a technically pure oxygen or by an oxygen-nitrogen mixture in such a manner that the combustion still takes place in a stoichiometric manner. The temperature of the carrier gas just downstream of the combustion source is maintained flexible by means of the controllable adjustment of a selected oxygen-nitrogen ratio in such a manner that a milder thermal comminution and a substantially uncracked pyrolytic gas are obtained, said gas diffusing into the smoke gas stream which is low in inert components.

The slightly diluted pyrolytic gases including the tars and dusts may be introduced into a downstream gasification apparatus without cooling subsequent to the separation of the gas from the solid material in a heat exchanged cyclone. The liquid and solid components contained in the remainder gas may be gasified by means of oxygen and water vapor. These components are then cleaned in a simple gas cleaning apparatus connected downstream of the gasifying device.

By a flexible and quantity controlled supply of oxygen it becomes possible to establish respective energy profiles in a horizontal flow reactor and thus to provide an adjustment relative to the respective coal type in such a manner that a grain structure may be produced which is necessary for the subsequent hot briquetting. Thus, it will be appreciated, that the oxygen functions as the regulating or control quantity for corresponding process conditions.

The heat transfer to the moist coal grain is substantially influenced by the sensible heat of the hot fire gases from the combustion chamber. In addition, the radiation energy also exerts a controlling influence on said heat transfer. However, the sum of the energy to be transferred is directly proportional to the fourth power of the temperature. On the other hand, the emission power decreases with increasing temperature. Thus, it is necessary to achieve a certain process technical equilibrium. More favorable partial pressure ratios or conditions result due to the reduction of the nitrogen proportion by the use of oxygen. Such more favorable partial pressure conditions result in an increased radiation intensity whereby it becomes possible for the above mentioned necessary energy profile that the combustion temperatures of the smoke gases may be lower.

The radiated energy of the body of gas (smoke gas) depends from the total emission number $\epsilon$ and from its respective temperature.

$$E = f(\epsilon, T^4)$$

However, since the total emission number $\epsilon$ is on its part also a function of the temperature, pressure and layer thickness and since the layer thickness is inversely proportional to the temperature, it is necessary to provide an optimization of the energy transfer.

Different emission numbers are achieved at constant partial pressure and layer thickness (diameter of the reactor) and at variable temperatures. If the temperature becomes $T_1 < T_2$, and if the product of the partial pressure and the layer thickness remains the same, an increase in the emission number $\epsilon$ will result. If one further takes into account the presence of multi-gas components ($H_2O$, CO, $CO_2$, $N_2$ etc.), there exists a mutual influence in the radiation numbers such that a lower emissivity occurs due to the semi-permeability of the gas content materials.

From the relationship between the emission number, the layer thickness, the partial pressure, and the temperature, it is possible to deduct the following relationships which permit a defined technical control of the apparatus and process of the reactor for heating the suspended carbon particles to achieve a higher flexibility and defined granular structures.

It is possible to adjust the type of treatment to the quality of the coal because, after the thermal heating process, the behavior of the inert component is of controlling influence on the downstream heat transfer to the solid material and on the following briquetting, and also on the quality of the product.

A three phase grain structure heretofore described, is produced by the use of oxygen resulting in a more intensive heat transfer and depending on the type of coal used. Such a grain structure may be achieved by a milder thermal treatment, especially where highly volatile coals are used. The flexibility in the heating of the coal is substantially rigidly fixed in known processes because in addition to the fixed relationship between gas and air, a determined mixture temperature results which is strongly influenced by the temperature of the inert component. With regard to the question of gas volume reduction in a heating pipe, one knows from experience that the length and diameter of the reactor may be kept variable while still achieving the same end results. Especially the diameter may be variable up to 100%.

Simultaneously a gas is produced having a higher calorific value and a lower gas volume due to the use of oxygen so that the downstream process elements as well as the actual main stage may be constructed in a more compact manner. This feature is considered to be essential especially with regard to a plant expansion characteristic because the separation efficiencies of cyclones depend on the throughput and the temperature.

The following figure example illustrates the possibilities resulting from the use of oxygen as taught by the invention. Coal base material:

| | |
|---|---|
| 34% | coking cementitious coal of a medium volatility |
| 50% | upper anthracite fine coal |
| 16% | upper lean coal |

Operating conditions:

| | |
|---|---|
| Gas consumption | 1120 $Nm^3/h$ |
| Combustion air | 3900 $Nm^3/h$ |
| Carrier air | 1220 $Nm^3/h$ |
| Total Exhaust Gas (mixed) | 6768 $Nm^3/h$ |

$Nm^3/h$ (standard cubic meters per hour)

Gas composition:

| | | |
|---|---|---|
| heavy hydrocarbons | 0.2% | (by volume) |
| CO | 2.2% | (by volume) |
| $H_2$ | 11.8% | (by volume) |
| $CH_4$ | 9.2% | (by volume) |
| $N_2$ | 68.8% | (by volume) |

Calorific value $H_u$ 1200 kcal/$Nm^3$

Results:

Reduction of the nitrogen proportion in the combustion air. Increase of the calorific value to about 3000 kcal/$Nm^3$. Reduction of the exhaust gas quantity by about 54% to about 3700 $Nm/^3h$.

In a number of tests the high temperature profile directly downstream of the combustion chamber was drastically lowered by means of spray water. The grain modifications resulting from this type of operation as initially measured in terms of bulk weight, showed that the coal grain remained coarser as compared to the normal process. Further the coal grain was less perforated and had a higher bulk weight. Starting from the assumption that by a given dosing of the gas, the oxygen, and the carrier air, the absolute temperature level just downstream of the combustion chamber is kept variable, one is now in a position to produce a definite bulk weight adjusted to the type of coal used in any particular instance.

Since the thermally heated coal grain must fulfill two different functions, with regard to the hot briquetting technique, namely, a heat transfer function, from solid material to solid material in the mixer, and on the other hand it shall still be compactable, the bulk weight may be considered to be the "target value" of the process.

The structure of the heated grain expresses itself in the value of the bulk weight. Thus, this value provides a measure for the heat storing capacity and the heat transfer. On the other hand, the bulk weight expresses the predensification of the material which is important for the briquetting.

It can be generally stated: The effective bulk weight and thus the compactness of the coal mass is so much the smaller the more porous and perforated the coal grain is. A grain having such a characteristic also results in a less efficient heat transfer.

Summarizing it can be said that with the predominating use of oxygen instead of nitrogen more favorable and more flexible partial pressure ratios or conditions are established in the flow reactor whereby a variable energy transfer to the coal grain is accomplished which in turn results in a simple way in the desired material behavior.

In the above outlined process steps a rich gas supplied from a remote source or the gas produced by the process is subjected to a stoichiometric combustion. The adjustment of the gas, the oxygen, and the carrier air is thus done in a stoichiometric ratio.

We claim:

1. A method for the production of fuel briquettes by hot pressing a mixture of a coal having a fine grain size which softens at the temperature at which the briquettes are pressed and of a component which is substantially undeformable at said temperature, wherein the starting components are heated to different temperatures prior to their being intermixed, by first introducing the non-softening component into a hot gas stream, as viewed in the flow direction, and then introducing the softening component into the hot gas stream, from which they are separated after heating, characterized in that pure oxygen or an oxygen/nitrogen mixture including more than 21% by volume of oxygen is used in such a manner as a process regulating medium and as a reaction component of a heat-up medium, preferrably in a ratio of 2:1 up to the stoichiometric ratio, and wherein a carrier gas stream, having temperatures between 1000° C to 1700° C, is produced in such a manner, that adjusted to the type of starting components which are present in grain sizes up to 14mm, granular structures are achieved which result in bulk weights of between $0.3t/m^3$ to $0.7t/m^3$ prior to the intermixing, at average or mean heat-up speeds of about 2500° C/sec and end temperatures of between 350° C to 700° C of the substantially undeformable component.

2. The process according to claim 1, characterized in that the gas separated from the starting components after the heat-up and during the intermixing of the starting components, is returned to the heat-up medium at least partially at temperatures of 400° C to 520° C, said return taking place after all solid, liquid, or gaseous pyrolytic products have been completely gasified by means of oxygen and/or hydrogen and after a downstream dust removal.

* * * * *